US005973487A

United States Patent [19]

Henry

[11] Patent Number: 5,973,487

[45] Date of Patent: Oct. 26, 1999

[54] METHODS AND APPARATUS FOR PROVIDING AN AUTOCALIBRATED VOLTAGE REFERENCE

[75] Inventor: Paul Mike Henry, Tucson, Ariz.

[73] Assignee: National Semiconductor Corporation, Santa Clara, Calif.

[21] Appl. No.: 09/112,406

[22] Filed: Jul. 8, 1998

[51] Int. Cl.[6] ..... G05F 3/16

[52] U.S. Cl. ..... 323/280; 323/907; 323/316

[58] Field of Search ..... 323/907, 280, 323/316, 281

[56] References Cited

U.S. PATENT DOCUMENTS

| | | | |
|---|---|---|---|
| 4,800,500 | 1/1989 | Tanaka | 701/111 |
| 5,124,663 | 6/1992 | McEntarfer et al. | 330/9 |
| 5,319,370 | 6/1994 | Signore et al. | 341/120 |
| 5,440,305 | 8/1995 | Signore et al. | 341/120 |

OTHER PUBLICATIONS

"A Low–Voltage CMOS Bandgap Reference" Eric A. Vittoz and Olivier Neyroud, IEEE Journal of Solid–State Circuits, vol. SC–14, No. 3, Jun. 1979.

*Primary Examiner*—Shawn Riley
*Attorney, Agent, or Firm*—Limbach & Limbach LLP; Seong-Kun Oh

[57] ABSTRACT

An autocalibrated voltage reference includes a continuous time reference and a switched calibration reference where continuous time reference is dynamically adjusted to match the switched reference such that the temperature drift and long term drift of the continuous time reference is matched to the low temperature drift of the switched reference and further resulting in improvement of the long term drift of the switched reference and of the entire system.

60 Claims, 4 Drawing Sheets

METHODS AND APPARATUS FOR PROVIDING AN AUTOCALIBRATED VOLTAGE REFERENCE

BACKGROUND OF THE INVENTION

1. Field of the Invention

The present invention generally relates to voltage references. More particularly, the present invention relates to autocalibrated voltage references which improves long term drift performance and optimizes reference performance characteristics without compromising reference voltage temperature drift and accuracy.

2. Description of the Related Art

The design of bandgap voltage references generally entails a series of trade offs of several different characteristics of the voltage references against accuracy and temperature drift. Often, the design of a voltage reference is optimized to consume the minimum amount of power supply current. With this optimization goal, however, it is difficult to maintain low temperature drift. The same is true when the design of the voltage reference is optimized for output voltage noise. In the latter case of output voltage noise, the core elements of the bandgap voltage reference is the major source of the output voltage noise. Thus, bandgap voltage references are not well suited for applications particularly sensitive to high levels of noise.

Other approaches, including operating metal oxide semiconductor (MOS) devices in the sub-threshold region to create a bipolar-like bandgap voltage reference, have higher temperature drift. On the other hand, while a buried zener does not exhibit a high temperature drift, it is not suited for a power supply of less than 5 volts. This is due to the fact that the normal operating voltage of a P-N junction operating in the zener breakdown region is approximately 6.5 volts. In addition, diodes are stacked on top of a zener such that the combined temperature coefficient is close to zero. Moreover, buried zener references commonly require a power supply in excess of 12 volts.

The change in semiconductor components, otherwise known as long term electronic ("voltage") drift, occurs during normal operation. This is a known accuracy limitation for a MOS voltage reference. For example, the gate-to-source voltage $V_{gs}$, of an N-channel metal-oxide semiconductor field effect transistor (MOSFET) can change as much as 10mV for the same drain current $I_d$ over a 1000 hour HTB reliability test. For MOSFETs, this drift is predominantly due to charge accumulation in the gate oxide as well as due to changes in the surface/oxide interface charge. The changes to the surface/oxide interface charge do not occur without power being applied to the gate and drain terminals of the MOSFET. Furthermore, measurements indicate that a MOS device with no power applied thereto does not experience voltage drift other than those shifts in threshold voltage and β (beta) that are due to relaxation from packaging stress. In turn, this packaging stress can be significantly reduced by several unpowered post-packaging temperature cycles prior to initial testing and calibration.

Even when the voltage reference is trimmed at the time of manufacturing to reduce or minimize the error from the desired ideal voltage, its output voltage drift as a function of time (referred to as long term stability) is approximately 100 parts per million (PPM) per volt for 1000 hours of operation over the operating life of the voltage reference.

SUMMARY OF THE INVENTION

In view of the foregoing, the present invention is directed to a low power, high precision voltage reference. More specifically, the present invention discloses methods and apparatus to allow the optimization of voltage references for noise and power supply current without sacrificing voltage temperature drift. Additionally, the present invention discloses substantial improvement in long term stability of the voltage reference.

Accordingly, an apparatus including a voltage reference circuit in accordance with one embodiment of the present invention includes a first reference circuit configured to provide a first reference signal, a second reference circuit configured to provide a second reference signal, a reference output terminal, and a comparator having first and second input terminals and an output terminal, where the first and second input terminals are configured to receive the first and second reference signals from the first and second reference circuits respectively, and in accordance therewith generate a plurality of comparator output signals. The apparatus in accordance with the present invention further includes a controller coupled to said comparator configured to receive the plurality of comparator output signals and in accordance therewith provide a control signal, and an adjuster configured to receive said plurality of comparator output signals and the control signal and in accordance therewith generate an adjusted signal. Moreover, the apparatus in accordance with the embodiment of the present invention set forth above is provided such that the second reference circuit receives the adjusted signal from the adjuster and in accordance therewith, provides a reference output circuit to the reference output terminal.

An apparatus including a window comparator in accordance with another embodiment of the present invention includes a first comparator configured to receive first and second reference signals and in accordance therewith provide a first comparator signal, and a second comparator including a predetermined offset configured to receive the first and second reference signals and in accordance therewith provide a second comparator signal; if the second reference signal is larger than said first reference signal, the first comparator generates a first comparator first signal, and, if said second reference signal is less than said first reference signal, the first comparator generates a first comparator second signal; and further, if said second reference signal with the predetermined offset subtracted therefrom is larger than the first reference signal, the second comparator generates a second comparator first signal, and, if the second reference signal with the predetermined offset subtracted therefrom is less than said first reference signal, the second comparator generates a second comparator second signal.

An apparatus including an input stage of an offset comparator in accordance with still another embodiment of the present invention includes an offset switch configured to selectively provide a controlled offset signal, an offset transistor coupled to the offset switch configured to provide a comparator offset signal, and a plurality of input transistors configured to receive a plurality of offset comparator input signal. In accordance with the present invention, and in particular, the input stage as set forth herein, the plurality of input transistors is coupled is to the offset transistor configured to receive the comparator offset signal, and further the one of said plurality of input transistors is also coupled to the offset switch configured to selectively receive the controlled offset signal, and in accordance therewith, provide an offset comparator input stage output signal. Accordingly, the comparator offset signal is determined the size ratio of the offset transistor and either one of the plurality of input transistors.

An apparatus including an offset comparator in accordance with yet another embodiment of the present invention includes a first input terminal configured to receive an offset comparator first input signal; a second input terminal configured to receive an offset comparator second input signal; a reference terminal configured to provide a reference signal, and a plurality of input transistors coupled to the first and second input terminals configured to selectively receive the offset comparator first and second input signals and said reference signal. The apparatus including the offset comparator also includes an amplifier circuit configured to selectively provide offset compensation to the plurality of input transistors; a plurality of switches coupled to the plurality of input transistors, said reference terminal and the amplifier circuit, a controller coupled to the plurality of switches configured to selectively provide control signals to the plurality of switches, and an offset transistor coupled to the one of the plurality of input transistors configured to provide a comparator offset signal. Accordingly, the comparator offset signal is determined in accordance with the size ratio of the offset transistor and either one of the plurality of input transistors, and further, the plurality of switches selectively couples the plurality of input transistors, the reference terminal and said amplifier circuit, and in accordance therewith, generate an offset comparator output signal.

A method of optimizing a voltage reference circuit for low voltage drift in accordance with a further embodiment of the present invention includes the steps of, receiving first and second reference signals, comparing the first and said second reference signals in accordance with a predetermined offset, generating a comparison signal in accordance with said comparing step, and modifying the second reference signal in accordance with the comparison signal.

A method for providing a window comparator in accordance with still yet another embodiment of the present invention includes the steps of, receiving first and second reference signals and in accordance therewith providing a first comparator signal, receiving said first and second reference signals and a predetermined offset, and in accordance therewith providing a second comparator signal. The method set forth herein in accordance with the present invention provides, if the second reference signal is larger than the first reference signal, generating a step of a first comparator first signal, and, if said second reference signal is less than said first reference signal, generating a step of a first comparator second signal. Furthermore, in accordance with the present invention and if the second reference signal with the predetermined offset subtracted therefrom is larger than the first reference signal, generating a step of a second comparator first signal is provided, and further if said second reference signal with said predetermined offset subtracted therefrom is less than said first reference signal, said second comparator generates a second comparator second signal.

There, the invention set forth in the present application provides method and apparatus for an autocalibrated voltage reference which includes a continuous time reference and a switched calibration reference which includes a continuous time reference is dynamically adjusted to match the switched reference such that the temperature drift and long term drift of the continuous time reference is matched to the low temperature drift of the switched reference and further resulting in improvement of the long term drift of the switched reference and of the entire system.

These and other features and advantages of the present invention will be understood upon consideration of the following detailed description of the invention and the accompanying drawings.

DETAILED DESCRIPTION OF THE INVENTION

Figure 1:
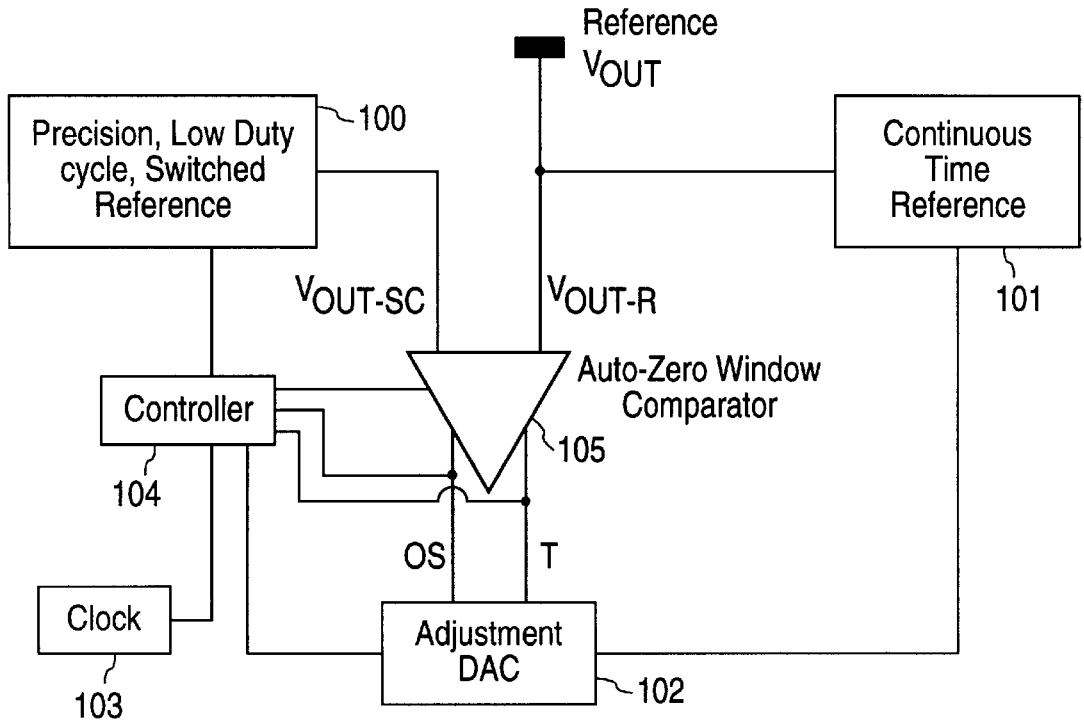
FIG. 1 illustrates a block diagram of an autocalibrated voltage reference in accordance with one embodiment of the present invention.

FIG. 1 illustrates a block diagram of the autocalibrated voltage reference in accordance with one embodiment of the present invention. As shown, there is provided a precision, low duty cycle switched reference 100, a continuous time reference 101 which can be configured for either low noise or very low power, an adjuster such as a digital-to-analog converter (DAC) 102, an auto zero window comparator 105, and a controller 104 for controlling the switched reference 100, the adjuster 102 and the window comparator 105. The adjuster 102 in accordance with one embodiment of the present invention can be a monotonic continuous time digital-to analog converter which is configured to adjust the output signal of the continuous time reference 101 in accordance with control signals from the controller 104. The continuous time reference 101 in accordance with one embodiment of the present invention operates as a reference interface (of the autocalibrated voltage reference) to other parts of the circuitry, and is always kept on. Also shown in FIG. 1 is a clock 103 which supplies clock signals to the controller 104 for synchronization.

As can be seen from FIG. 1, the switched reference 100 and the continuous time reference 101 are coupled to the auto-zero window comparator 105. Moreover, the output of the window comparator 105 is coupled to the adjustment DAC 102 which, in turn, is coupled to the continuous time reference 101. There is also provided a reference output node $V_{OUT}$, which is coupled to one of the input terminals of the window comparator 105 as well as the output of the continuous time reference 101.

On command from the controller 104 or at power up, the window comparator 105 and the switched reference 100 are powered up and zeroed such that there are no offset errors in the window comparator 105. Then, the window comparator 105 compares the output signal $V_{OUT\text{-}SC}$ of the switched reference 100 to the output signal $V_{OUT\text{-}R}$ of the continuous time reference 101 to generate comparator output signals, T, OS, which are then provided to the adjustment DAC 102 and to the controller 104. The controller 104 receives the comparator output signals from the window comparator 105 and in accordance therewith generate control signals. The adjustment DAC 102 then receives the control signals from the controller 104 as well as the comparator output signals from the window comparator 105 to determine if and by how much the continuous time reference signal from the continuous time reference 101 needs to be modified.

The operation of the window comparator 105 which receives output signals $V_{OUT\text{-}SC}$ and $V_{OUT\text{-}R}$ from the switched reference 100 and the continuous time reference 101, respectively, as well as the operation of the adjustment DAC 102 will be described in further detail below in conjunction with FIG. 3.

Figure 2:
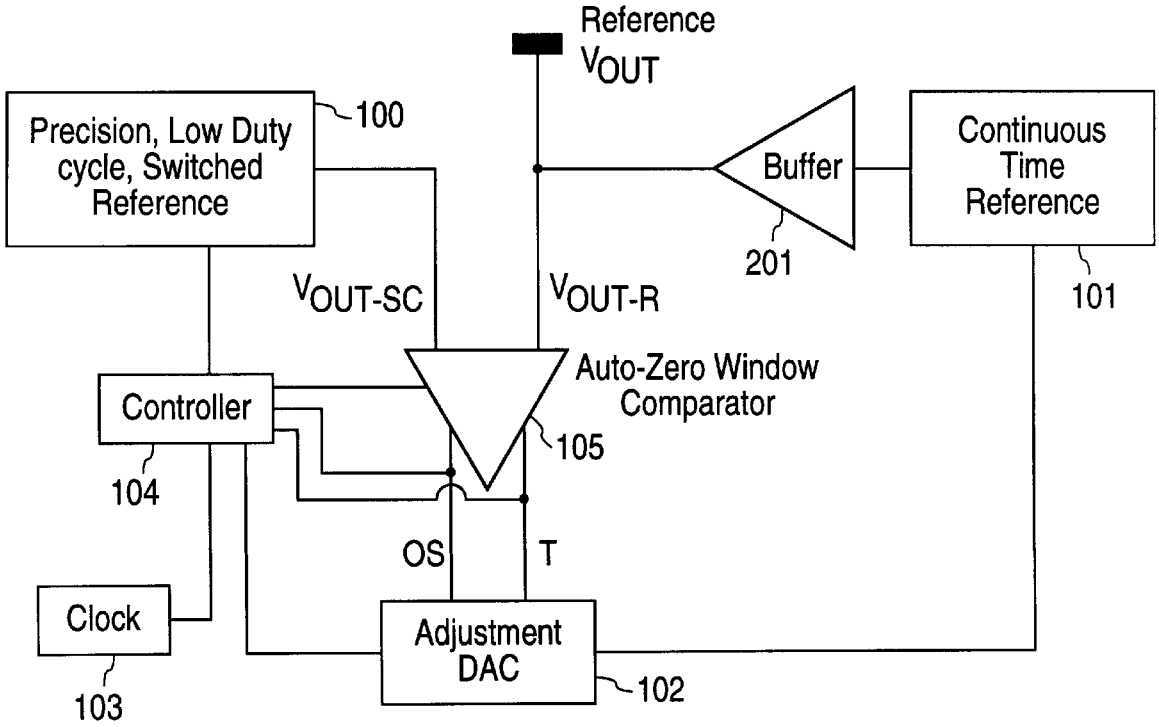
FIG. 2 illustrates a block diagram of an autocalibrated voltage reference in accordance with another embodiment of the present invention.

FIG. 2 illustrates another embodiment of the voltage reference in accordance with the present invention. Like parts are similarly labeled as those illustrated in FIG. 1 and operate in a similar manner. In the embodiment shown in FIG. 2, there is further provided an output voltage buffer 201 between the continuous time reference 101 and the reference node $V_{OUT}$. As shown in the Figure, the output voltage buffer 201 is configured to supply more load current to a load coupled to the reference node $V_{OUT}$ and to provide a lower output impedance. In this manner, any offset including drift with respect to temperature and long term drift in the buffer circuitry can be calibrated with the adjustment DAC 102 according to conventional approaches. For example, some of these approaches include adding or subtracting a voltage inside the continuous time reference 101, adding, subtracting, or changing the ratio of the current in the continuous time reference 101, or changing the resistor value in the continuous time reference 101 by switching a resistor or a series of resistors in or out.

Figure 3:
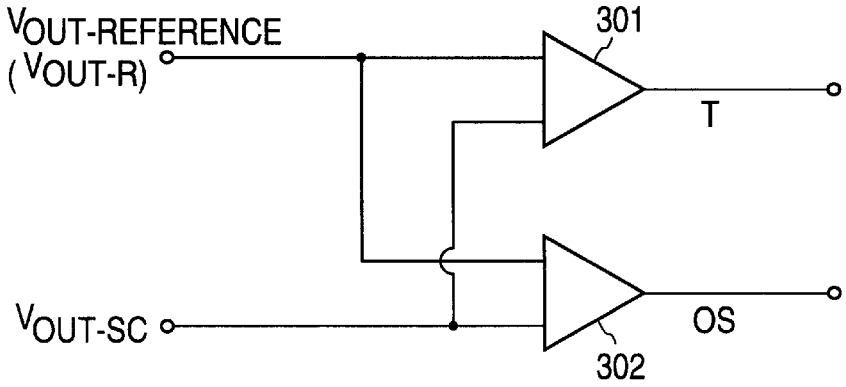
FIG. 3 illustrates a detailed illustration of an auto-zero window comparator as shown in FIGS. 1 and 2 in accordance with still another embodiment of the present invention.

FIG. 3 illustrates the window comparator 105 of FIGS. 1 and 2 in further detail. As shown, there are provided two comparators: a zeroed comparator 301 and an offset comparator 302 which has a built-in, controlled offset voltage $V_{OS}$. The zeroed comparator 301 and the offset comparator 302 are each configured to receive output signals $V_{OUT\text{-}SC}$ and $V_{OUT\text{-}R}$ of the switched reference 100 and the continuous time reference 101, respectively, and provide respective comparator output signals T and OS to the adjustment DAC 102 (FIGS. 1 and 2). The values of the comparator output signals T and OS are determined in accordance with the comparison results between output signals $V_{OUT\text{-}SC}$ and $V_{OUT\text{-}R}$ of the switched reference 100 and the continuous time reference 101, respectively, of FIGS. 1 and 2.

Figure 4:
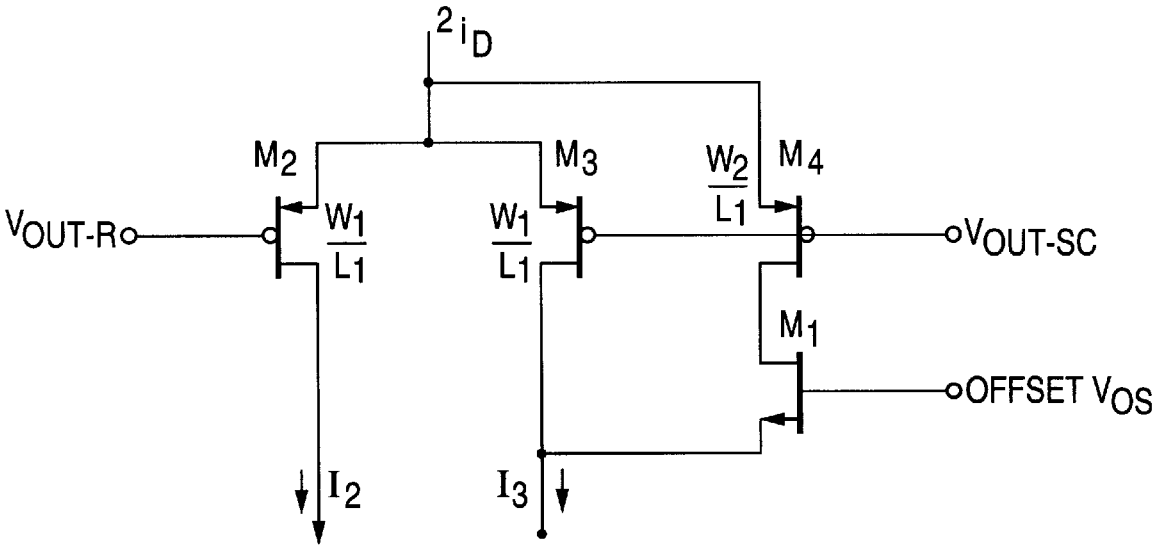
FIG. 4 illustrates a detailed schematic of the offset comparator as shown in FIG. 3 in accordance with yet another embodiment of the present invention.

In operation, the offset comparator 302 is initialized by first turning off the built-in controlled offset voltage $V_{OS}$ thereby zeroing any unexpected and uncontrolled offsets, and then turning on the controlled offset voltage $V_{OS}$ as will be further explained in conjunction with the input stage of the offset comparator 302 as shown in FIG. 4. A voltage window is thus established with the boundaries of the voltage window determined by the manner in which the zeroed comparator 301 and the offset comparator 302 respectively react to a same input signal. Moreover, the magnitude of the voltage window is determined by the magnitude of the controlled offset voltage $V_{OS}$.

If the output signal $V_{OUT\text{-}SC}$ of the switched reference 100 is greater than the output signal $V_{OUT\text{-}R}$ of the continuous time reference 101, the comparator output signal T of zeroed comparator 301 is set to one "1". If the output signal $V_{OUT\text{-}SC}$ of the switched reference 100 is lower than the output signal $V_{OUT\text{-}R}$ of the continuous time reference 101, then the comparator output signal T of the zeroed comparator 301 is set to zero "0".

At the offset comparator 302, if the output signal $V_{OUT\text{-}SC}$ of the switched reference 100, after subtracting the built-in controlled offset voltage $V_{OS}$ of the offset comparator 302, is greater than the output signal $V_{OUT\text{-}R}$ of the continuous time reference 101, then the comparator output signal OS of the offset comparator 202 is set to one "1". On the other hand, if the output signal $V_{OUT\text{-}SC}$ of the switched reference 100 after subtracting the controlled offset voltage $V_{OS}$, is smaller than the output signal $V_{OUT\text{-}R}$ of the continuous time reference 101, then the comparator output signal OS of the offset comparator 302 is set to zero "0".

Referring back to FIGS. 1 and 2, in the above-described manner, the window comparator 105 provides the controller 104 with three conditions in which to control the adjustment DAC 102. When the comparator output signals T and OS of comparators 301 and 302, respectively, are both "1", then the controller 104 controls the adjustment DAC 102 to decrease the output signal $V_{OUT\text{-}R}$ of the continuous time reference 101.

When the output signal T of the zeroed comparator 301 shown in FIG. 3 is a one "1" and the output signal OS of the offset comparator 302 also shown in FIG. 3 is a zero "0", then the controller 104 controls the adjustment DAC 102 to do nothing. In other words, when the output signal T of the zeroed comparator 301 is "1" and the output signal OS of the offset comparator 302 is "0", the continuous time reference 101 is determined to be within the voltage range of the switched capacitor reference 100 established by the controlled offset controlled $V_{OS}$ of the offset comparator 302. It is to be further noted that the magnitude of the controlled offset voltage $V_{OS}$ is a controlled value and can thus be modified to suit the amount of precision desired in the specific design.

Finally, when the output signal $V_{OUT\text{-}R}$ of the continuous time reference 101 alone, as well as after subtracting the built-in controlled offset voltage $V_{OS}$ of the offset comparator 302, is smaller than the output signal $V_{OUT\text{-}SC}$ of the switched reference 100, the controller 104 controls the adjustment DAC 102 to increase the output signal $V_{OUT\text{-}R}$ of the continuous time reference 101. That is, when the comparator output signals T and OS of the comparators 301 and 302, respectively, are both zeros "0", the output signal $V_{OUT\text{-}R}$ of the continuous time reference 101 is increased.

In the manner described above, in accordance with the present invention, the switched reference 100 is optimized for low voltage drift. More specifically, the switched reference 100 is powered up, zeroed using switched capacitor techniques, and then compared to the continuous time reference 101. If there is no difference, then the switched reference 100 and the window comparator 105 are turned off. If there is a sufficiently large difference, the adjustment DAC 102 is used to "tune" the continuous time reference 101 until the two references match. After the matching is achieved, the switched reference 100 and the window comparator 105 are turned off.

Accordingly, a continuous time reference with high drift and low noise can be converted to a continuous time reference with low drift, excellent long term stability and low noise by using a switched, low duty cycle reference to calibrate the continuous time reference in accordance with the present invention. Moreover, the continuous time reference in accordance with the present invention can be optimized for conflicting system demands such as noise, low power, or low output impedance.

FIG. 4 illustrates a detailed schematic of the input stage of the offset comparator 302 of FIG. 3 in accordance with one embodiment of the present invention. As shown, transistors $M_2$ and $M_3$ are provided as input devices whose drain terminals are coupled to a predetermined load such as a resistor or an active load. As can be seen from FIG. 4, transistors $M_2$ and $M_3$ are matched. Transistor $M_1$ is used to switch the built-in controlled offset voltage $V_{OS}$ on and off in the offset comparator 302 (FIG. 3). Transistor $M_4$ is provided as the offset device characterized in that it is much smaller than the two input devices, transistors $M_2$ and $M_3$. In other words, the amount of the offset created by transistor $M_4$ is controlled by the ratio of the sizes between transistor $M_4$ and transistors $M_2$, $M_3$.

In operation, the input terminals $V_{OUT-R}$, $V_{OUT-SC}$ are first shorted and the offset comparator 302 is zeroed with transistors M3 and M4 in parallel (i.e., the gate terminal of transistor $M_1$ is high). Then, upon completion of the zeroing operation, the transistor $M_1$ is turned off, and then, the controlled offset voltage $V_{OS}$ is generated whose value is proportional to the size relationship between the input transistors $M_2$, $M_3$ and the offset transistor $M_4$. The controlled offset voltage $V_{OS}$ thus generated is such that the voltage $V_{OUT-R}$ is slightly lower voltage than the voltage $V_{OUT-SC}$ for the comparator to switch according to the present invention. Alternatively, the controlled offset voltage $V_{OS}$ can be generated by shorting the input terminals, $V_{OUT-R}$ and $V_{OUT-SC}$, and zeroing the offset comparator 302 with the gate terminal of transistor $M_1$ low (i.e., the transistor $M_1$ is off). Upon completion of the zeroing operation, transistor $M_1$ is immediately turned on thus generating the controlled offset voltage $V_{OS}$ as previously described but with the opposite polarity.

In other words, with transistor $M_1$ turned on, and transistors $M_2$ and $M_3$ matched, the source current $I_2$ of transistor $M_2$ equals the source current $I_3$ of transistor $M_3$, and, the controlled offset voltage $V_{OS}$ can be determined as follows:

$$V_{OS}=V_{gs_2}-V_{gs_{3-4}} \tag{1}$$

where $V_{gs_2}$ is the gate to source voltage of transistor $M_2$ while $V_{gs_{3-4}}$ is the voltage between the gate terminal of transistor $M_3$ and the source terminal of transistor $M_4$. In turn, the gate-to-source voltage $V_{gs2}$ of transistor $M_2$ can be determined by the following expression.

$$V_{gs_2} = V_T + \sqrt{\frac{2}{\beta}\frac{L_1}{W_1} - 2d} \tag{2}$$

Additionally, the gate-to-source voltage $V_{gs_{3-4}}$ between the gate terminal of transistor $M_3$ and the source terminal of transistor $M_4$ can be determined by the following expression.

$$V_{gs_3} - 4 = V_T\sqrt{\frac{2}{\beta}\frac{L_1}{(W_1 + W_2)}2d} \tag{3}$$

Since the source currents of $I_2$ and $I_3$ of transistors $M_2$ and $M_3$, respectively are equal to twice the drain current $i_d$, the controlled offset voltage $V_{OS}$ of Equation 1 can be alternatively expressed as follows:

$$V_{OS} = \sqrt{\frac{2}{\beta}i_d}\left(\frac{\sqrt{L_1}}{\sqrt{W_1}} - \frac{\sqrt{L_1}}{\sqrt{W_1 + W_2}}\right) \tag{4}$$

By way of simplification, the following expression can be determined from Equation 4.

$$V_{OS} = \sqrt{\frac{2}{\beta}i_d L_1}\left(\frac{1}{\sqrt{W_1}} - \frac{1}{\sqrt{W_1 + W_2}}\right) \tag{5}$$

Figure 5:
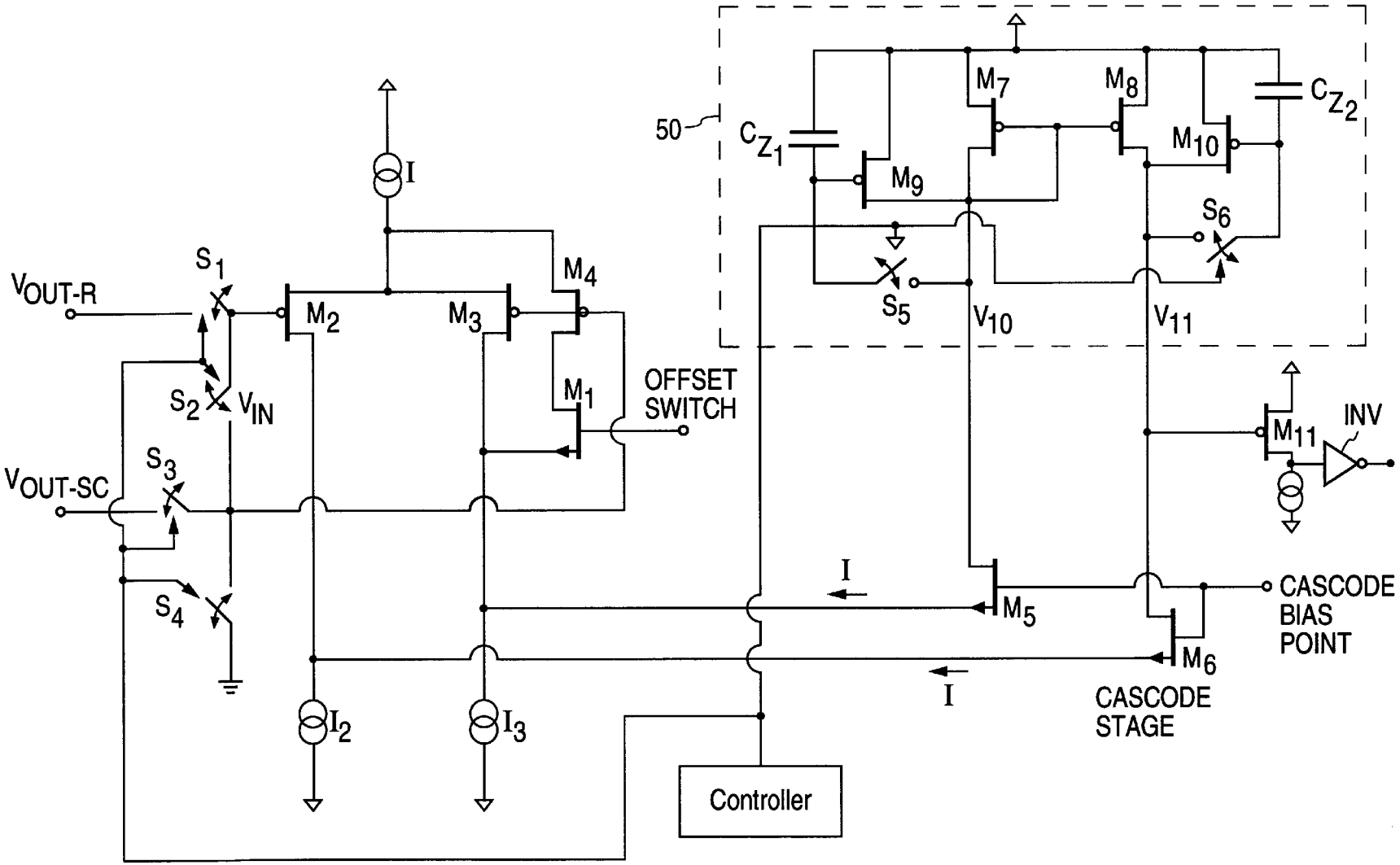
FIG. 5 illustrates a further detailed schematic of the offset comparator as shown in FIG. 4.

FIG. 5 illustrates a further detailed view of the offset comparator 302 of FIG. 3. As shown, there is provided an amplifier circuit 50 which is configured to compensate for offset errors. Such amplifier circuit is described in further detail in U.S. Pat. No. 5,124,663 the disclosure of which is incorporated herein by reference. As explained in further detail below, transistors $M_5$ and $M_6$ operate in a folded cascode configuration with the amplifier circuit 50 to compensate for the offset errors.

During the initialization (or "zeroing") stage, switches Si and $S_3$ are opened while switches $S_2$, $S_4$, $S_5$ and $S_6$ are closed. On the other hand, during normal operation, switches $S_1$ and $S_3$ are closed while all switches (i.e., switches $S_2$, $S_4$, $S_5$ and $S_6$) are opened.

In particular, during the zeroing phase, with switch $S_5$ closed, the drain current $I_{D5}$ of transistor $M_5$ is divided equally between transistor $M_7$ and $M_9$. The drain current $I_{D8}$ of transistor $M_8$ is similar to or matches that of transistor $M_7$. The difference between the drain current $I_{D6}$ of transistor $M_6$ and the drain current $I_{D8}$ of transistor $M_8$ is supplied by transistor $M_{10}$. The gate-to-source voltage $V_{gs}$ of transistors $M_9$ and $M_{10}$ are stored in capacitors $C_{Z1}$ and $C_{Z2}$, respectively.

When switches $S_5$ and $S_6$ are open, the drain currents from transistors $M_9$ and $M_{10}$ are provided to transistors $M_5$ and $M_6$ since gate voltages of transistors $M_9$ and $M_{10}$ are held on the capacitors $C_{Z1}$ and $C_{Z2}$ respectively. This, in turn, causes the node voltages $V_{10}$ and $V_{11}$ to be approximately equal when voltage $V_{OUT-R}$ equals voltage $V_{OUT-SC}$. Then, switches $S_2$ and $S_4$ are opened and switched $S_1$ and $S_3$ are closed, thus completing the zeroing cycle.

The switching sequence of the six switches shown in FIG. 5 and as described above are further illustrated in the following table below.

TABLE 1

Offset Comparator Switching Operation

| Operation | $S_1$ | $S_2$ | $S_3$ | $S_4$ | $S_5$ | $S_6$ |
|---|---|---|---|---|---|---|
| Zeroing | O | X± | O | X± | X | X |
| Normal | X | O | X | O | O | O |

where the "O" indicates that the particular switch is opened and the "X" indicates that the particular switch is closed during the designated operation Moreover, the "X±" indicates that the during the zeroing stage, the corresponding switch ($S_2$ or $S_4$) is closed before the switches that are configured to close during this stage (i.e., switches $S_5$ and $S_6$), and further, that at the normal operation, this switch ($S_2$ or $S_4$) is opened after the switches $S_5$ and $S_6$ are opened. Therefore, in accordance with the present invention, switches $S_2$ and $S_4$ configured to close before and to open after switches $S_5$ and $S_6$ close and open respectively.

Mismatches between the gate-to-source voltages $V_{gs}$ of transistors $M_2$ and $M_3$ result in mismatches in the drain currents $I_d$ of transistors $M_5$ and $M_6$. In addition, mismatches between the current sources $I_2$ and $I_3$, and mismatches between the transistors $M_7$ and $M_8$ also contribute to the offset in the input stage of the auto-zero window comparator 105 (FIGS. 1 & 2). Thus, this combined offset must be preliminarily zeroed before the controlled offset is provided to the adjustment DAC 102 by way of the transistor $M_1$ operating as a switch. The preliminary zeroing of the combined offsets can be achieved by resetting the current in transistor $M_{10}$ such that the initial mismatch between the drain currents $I_{D5}$ and $I_{D6}$ of transistors $M_5$ and $M_6$, respectively, as well as the mismatches between the drain currents $I_{D7}$ and $I_{D8}$ of transistors $M_7$ and $M_8$, respectively, are matched. This operation allows small changes in the current ratio of the drain currents $I_{D5}$ and $I_{D6}$ of transistors $M_5$ and $M_6$ during normal operation to appear as large changes in the voltages $V_{10}$ and $V_{11}$.

Figure 6:
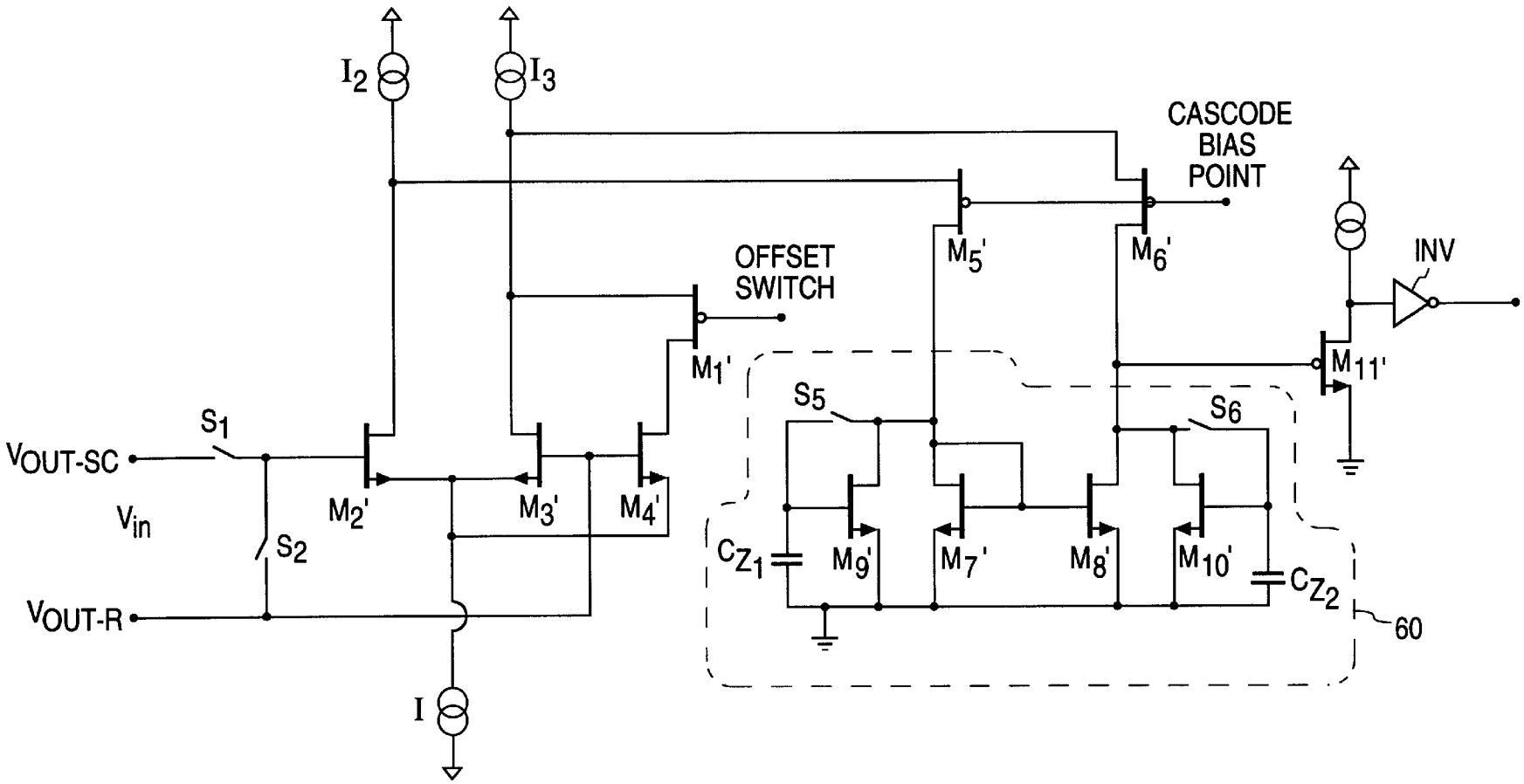
FIG. 6 illustrates yet another detailed schematic of the offset comparator as shown in FIG. 4.

FIG. 6 illustrates yet another detailed schematic of the offset comparator as shown in FIG. 3. As compared with the detailed schematic of the offset comparator as shown in FIG. 5, the embodiment of FIG. 6 is substantially similar to that of FIG. 5 except that the p-channel field effect transistors (FETs) used in the embodiment of FIG. 5 is now replaced with n-channel field effect transistors. The descriptive operation of the various parts illustrated in FIG. 5 likewise apply to the corresponding components in FIG. 6 including the switching of the four switches $S_1$, $S_2$, $S_5$ and $S_6$ in FIG. 6, which is similarly governed by the sequence as illustrated in Table 1 above. It is to be further noted that in the embodiment of FIG. 6, corresponding switches $S_4$ and $S_5$ are omitted because in this embodiment, these two switches are not required to zero the reference voltage. This is due to the fact that the reference voltage is zeroed to the common mode voltage of the reference, providing the advantage of rejecting common mode errors.

Accordingly, in accordance with the present invention, two references, a continuous time reference and a calibrator reference, are used to provide autocalibration which separate temperature drift performance of the continuous time reference from other design requirements where the latter reference is a low duty cycle zeroed reference which serves to adjust the former reference.

By adjusting the continuous time reference to match the switched reference, the temperature drift and long term drift of the continuous reference is matched to the low temperature drift performance of the switched reference. Additionally, the long term drift of the switched reference is improved and thus, the long term stability of the entire system is improved. Moreover, the present invention allows having the core reference being off or unpowered during most of its operating life (for example, 99%), thus reducing the long term drift by a factor of more than 100. In this manner, a duty cycle of 0.1% can be achieved which could subsequently reduce the long term drift by more than 1000. As such, a designer is able to separate the long term drift performance of the reference circuit from the other design requirements.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a voltage reference circuit, comprising:

a first reference circuit configured to provide a first reference signal;

a second reference circuit configured to provide a second reference signal;

a reference output terminal;

a comparator having first and second input terminals and an output terminal, said first and second input terminals configured to receive said first and second reference signals from said first and second reference circuits respectively, and in accordance therewith generate a plurality of comparator output signals;

a controller coupled to said comparator configured to receive said plurality of comparator output signals and in accordance therewith provide a control signal; and an adjuster configured to receive said plurality of comparator output signals and said control signal and in accordance therewith generate an adjusted signal;

wherein said second reference circuit receives said adjusted signal from said adjuster and in accordance therewith, provides a reference output signal to said reference output terminal.

2. The apparatus of claim 1 wherein said first reference circuit is a continuous time reference.

3. The apparatus of claim 1 wherein said second reference circuit is a calibrated reference configured to selectively turn on and off in accordance with the control signal from the controller.

4. The apparatus of claim 3 wherein said calibrated reference is a low duty cycle switched capacitor.

5. The apparatus of claim 1 wherein said adjuster is a digital to analog converter.

6. The apparatus of claim 1 further including a clock coupled to said controller to provide a clock signal to said controller.

7. The apparatus of claim 1 further including a buffer coupled between said second reference circuit and said reference output terminal, said buffer configured to receive said reference output signal from said second reference circuit and in accordance therewith, provide an amplified reference output signal to said reference output terminal.

8. The apparatus of claim 7 wherein said buffer provides a lower output impedance.

9. An apparatus including a window comparator, comprising:

a first comparator configured to receive first and second reference signals and in accordance therewith provide a first comparator signal; and a second comparator including a predetermined offset configured to receive said first and second reference signals and in accordance therewith provide a second comparator signal;

wherein, if said second reference signal is larger than said first reference signal, said first comparator generates a first comparator first signal, and, if said second reference signal is less than said first reference signal, said first comparator generates a first comparator second signal; and further wherein, if said second reference signal with said predetermined offset subtracted therefrom is larger than said first reference signal, said second comparator generates a second comparator first signal, and, if said second reference signal with said predetermined offset subtracted therefrom is less than said first reference signal, said second comparator generates a second comparator second signal.

10. The apparatus of claim 9 wherein said first and second comparator first signals are 1, and further, wherein said first and second comparators second signals are 0.

11. The apparatus of claim 9 wherein said predetermined offset is approximately between ±300 to 500 micro-voltages.

12. An apparatus including an input stage of an offset comparator, comprising:

an offset switch configured to selectively provide a controlled offset signal;

an offset transistor coupled to said offset switch configured to provide a comparator offset signal; and a plurality of input transistors configured to receive a plurality of offset comparator input signals, one of said plurality of input transistors coupled to said offset transistor configured to receive said comparator offset signal, said one of said plurality of input transistors further coupled to said offset switch configured to selectively receive said controlled offset signal, and in accordance therewith provide an offset comparator input stage output signal;

wherein said comparator offset signal is determined in accordance with the size ratio of said offset transistor and either one of said plurality of input transistors.

13. The apparatus of claim 12 wherein said offset transistor is smaller than either of said plurality of input transistors.

14. The apparatus of claim 12 wherein each of said plurality of input transistors includes a drain terminal coupled to a predetermined load.

15. The apparatus of claim 14 wherein said predetermined load includes a resistor.

16. The apparatus of claim 12 wherein said plurality of input transistors are matched.

17. The apparatus of claim 12 wherein said offset switch is configured to provide said controlled offset signal to said one of said plurality of transistors during offset comparator initialization step, and further, wherein each of said plurality of offset comparator input signals is substantially equal during said initialization step.

18. The apparatus of claim 17 wherein said controlled offset signal is predetermined.

19. An apparatus including an offset comparator for use in a voltage reference circuit, comprising:

a first input terminal configured to receive an offset comparator first input signal;

a second input terminal configured to receive an offset comparator second input signal;

a reference terminal configured to provide a reference signal;

a plurality of input transistors coupled to said first and second input terminals configured to selectively receive said offset comparator first and second input signals and said reference signal;

an amplifier circuit configured to selectively provide offset compensation to said plurality of input transistors;

a plurality of switches coupled to said plurality of input transistors, said reference terminal and said amplifier circuit;

a controller coupled to said plurality of switches configured to selectively provide control signals to said plurality of switches; and an offset transistor coupled to said one of said plurality of input transistors configured to provide a comparator offset signal;

wherein said comparator offset signal is determined in accordance with the size ratio of said offset transistor and either one of said plurality of input transistors; and further wherein said plurality of switches selectively couples said plurality of input transistors, said reference terminal and said amplifier circuit, and in accordance therewith, generate an offset comparator output signal.

20. The apparatus of claim 19 further including an offset switch coupled to one of said plurality of input transistors configured to selectively provide a controlled offset signal therewith during an initialization stage of said offset comparator.

21. The apparatus of claim 19 wherein said offset transistor and said plurality of input transistors are n-channel field effect transistors.

22. The apparatus of claim 19 wherein said offset transistor and said plurality of input transistors are p-channel field effect transistors.

23. A method of optimizing a voltage reference circuit for low voltage drift, said method comprising the steps of:

receiving first and second reference signals;

comparing said first and said second reference signals in accordance with a predetermined offset;

generating a comparison signal in accordance with said comparing step; and modifying said second reference signal in accordance with said comparison signal.

24. The method of claim 23 further including the step of receiving said reference output signal and in accordance therewith, providing an amplified reference output signal.

25. A method for providing a window comparator, said method comprising the steps of:

receiving first and second reference signals and in accordance therewith providing a first comparator signal;

receiving said first and second reference signals and a predetermined offset, and in accordance therewith providing a second comparator signal;

if said second reference signal is larger than said first reference signal, generating a first comparator first signal, and, if said second reference signal is less than said first reference signal, generating a first comparator second signal; and if said second reference signal with said predetermined offset subtracted therefrom is larger than said first reference signal, generating a second comparator first signal, and, if said second reference signal with said predetermined offset subtracted therefrom is less than said first reference signal, said second comparator generates a second comparator second signal.

26. The method of claim 25 wherein said first and second comparator first signals are 1, and further, wherein said first and second comparator second signals are 0.

27. The method of claim 25 wherein said predetermined offset is approximately between ±300 to 500 micro-voltages.

28. The apparatus of claim 2 wherein said second reference circuit is a calibrated reference configured to selectively turn on and off in accordance with the control signal from the controller.

29. The apparatus of claim 3 wherein said calibrated reference is a low duty cycle switched capacitor.

30. The apparatus of claim 2 wherein said adjuster is a digital to analog converter.

31. The apparatus of claim 2 further including a clock coupled to said controller to provide a clock signal to said controller.

32. The apparatus of claim 2 further including a buffer coupled between said second reference circuit and said reference output terminal, said buffer configured to receive said reference output signal from said second reference circuit and in accordance therewith, provide an amplified reference output signal to said reference output terminal.

33. The apparatus of claim 32 wherein said buffer provides a lower output impedance.

34. The apparatus of claim 4 wherein said adjuster is a digital to analog converter.

35. The apparatus of claim 4 further including a clock coupled to said controller to provide a clock signal to said controller.

36. The apparatus of claim 4 further including a buffer coupled between said calibrated reference and said reference output terminal, said buffer configured to receive said reference output signal from said calibrated reference and in accordance therewith, provide an amplified reference output signal to said reference output terminal.

37. The apparatus of claim 36 wherein said buffer provides a lower output impedance.

38. The apparatus of claim 5 further including a clock coupled to said controller to provide a clock signal to said controller.

39. The apparatus of claim 5 further including a buffer coupled between said second reference circuit and said reference output terminal, said buffer configured to receive said reference output signal from said second reference circuit and in accordance therewith, provide an amplified reference output signal to said reference output terminal.

40. The apparatus of claim 39 wherein said buffer provides a lower output impedance.

41. The apparatus of claim 6 further including a buffer coupled between said second reference circuit and said reference output terminal, said buffer configured to receive said reference output signal from said second reference circuit and in accordance therewith, provide an amplified reference output signal to said reference output terminal.

42. The apparatus of claim 41 wherein said buffer provides a lower output impedance.

43. The apparatus of claim 10 wherein said predetermined offset is approximately between ±300 to 500 micro-voltages.

44. The method of claim 26 wherein said predetermined offset is approximately between ±300 to 500 micro-voltages.

45. The apparatus of claim 13 wherein each of said plurality of input transistors includes a drain terminal coupled to a predetermined load.

46. The apparatus of claim 45 wherein said predetermined load includes a resistor.

47. The apparatus of claim 13 wherein said plurality of input transistors are matched.

48. The apparatus of claim 13 wherein said offset switch is configured to provide said controlled offset signal to said one of said plurality of transistors during offset comparator initialization step, and further, wherein each of said plurality of offset comparator input signals is substantially equal during said initialization step.

49. The apparatus of claim 48 wherein said controlled offset signal is predetermined.

50. The apparatus of claim 15 wherein said plurality of input transistors are matched.

51. The apparatus of claim 15 wherein said offset switch is configured to provide said controlled offset signal to said one of said plurality of transistors during offset comparator initialization step, and further, wherein each of said plurality of offset comparator input signals is substantially equal during said initialization step.

52. The apparatus of claim 51 wherein said controlled offset signal is predetermined.

53. The apparatus of claim 14 wherein said plurality of input transistors are matched.

54. The apparatus of claim 14 wherein said offset switch is configured to provide said controlled offset signal to said one of said plurality of transistors during offset comparator initialization step, and further, wherein each of said plurality of offset comparator input signals is substantially equal during said initialization step.

55. The apparatus of claim 54 wherein said controlled offset signal is predetermined.

56. The apparatus of claim 16 wherein said offset switch is configured to provide said controlled offset signal to said one of said plurality of transistors during offset comparator initialization step, and further, wherein each of said plurality of offset comparator input signals is substantially equal during said initialization step.

57. The apparatus of claim 56 wherein said controlled offset signal is predetermined.

58. The apparatus of claim 20 wherein said offset transistor and said plurality of input transistors are n-channel field effect transistors.

59. The apparatus of claim 20 wherein said offset transistor and said plurality of input transistors are p-channel field effect transistors.

60. The apparatus of claim 21 wherein said offset transistor and said plurality of input transistors are p-channel field effect transistors.

* * * * *